US006303918B1

(12) United States Patent
Estrera et al.

(10) Patent No.: US 6,303,918 B1
(45) Date of Patent: Oct. 16, 2001

(54) METHOD AND SYSTEM FOR DETECTING RADIATION INCORPORATING A HARDENED PHOTOCATHODE

(75) Inventors: Joseph P. Estrera, Dallas; Adriana Giordana; John W. Glesener, both of Richardson, all of TX (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/383,116

(22) Filed: Aug. 25, 1999

(51) Int. Cl.[7] ..... H01J 31/50; H01J 40/14

(52) U.S. Cl. ..... 250/207; 250/214 VT; 313/103 CM

(58) Field of Search ..... 250/207, 214 VT, 250/372, 374; 313/103 CM, 105 CM, 105 R

(56) References Cited

U.S. PATENT DOCUMENTS 4,339,659 * 7/1982 Johnson ..... 250/214 VT
5,015,909 * 5/1991 Zhong et al. ..... 313/105 R
5,697,826 * 12/1997 Kim et al. ..... 445/58

* cited by examiner

*Primary Examiner*—Stephone B. Allen
(74) *Attorney, Agent, or Firm*—Baker Botts L.L.P.

(57) ABSTRACT

A method for detecting radiation comprising nine steps is disclosed. Step one, forming a detector having a photocathode (22) with a protective layer (22*c*) of cesium, oxygen and fluorine; a microchannel plate (MCP) (24); and an electron receiver (26). Step two, receiving radiation at the photocathode (22). Step three, photocathode (22) discharging electrons (34) in response to the received photons. Step four, accelerating discharged electrons (34) from the photocathode (22) to the input face (24*a*) of the microchannel plate (24). Step five, receiving the electrons (34) at the input face (24*a*) of the microchannel plate (24). Step six, generating a cascade of secondary emission electrons (36) in the microchannel plate (24) in response to the received electrons (34). Step seven, emitting the secondary emission electrons (36) from the output face (24*b*) of the microchannel plate (24). Step eight, receiving secondary emission electrons (36) at the electron receiver (26). Step nine, producing an output characteristic of the secondary emission electrons (36). A device for detecting radiation is disclosed. The device comprises a photocathode (22), a microchannel plate (24) and an electron receiver (26). The photocathode (22) is operable to receive radiation on an input side (22*a*) and to discharge electrons (34) from its output side (22*b*) in response. The output side (22*b*) of the photocathode (22) has a protective layer (22*c*) comprising cesium, oxygen and fluorine. The microchannel plate (24) serves to receive electrons (34) on its input face (24*a*) from the photocathode (22), to produce a cascade of secondary emission electrons (36) and to discharge those electrons (36) from its output face (24*b*). The electron receiver (26) is operable to receive secondary emissions electrons (36) from the microchannel plate (24) and to produce an output characteristic of those electrons (36).

15 Claims, 2 Drawing Sheets

METHOD AND SYSTEM FOR DETECTING RADIATION INCORPORATING A HARDENED PHOTOCATHODE

TECHNICAL FIELD OF THE INVENTION

This invention relates generally to the field of electro-optics and, more specifically, to a method and system for detecting radiation incorporating a photocathode that is protected from damage by collisions with positive ions.

BACKGROUND OF THE INVENTION

There are numerous methods and systems for detecting radiation. In one type of detector, photocathodes are used in conjunction with microchannel plates (MCPs) to detect low levels of electromagnetic radiation. Photocathodes emit electrons in response to exposure to photons. The electrons can then be accelerated by electrostatic fields toward a microchannel plate. A microchannel plate is typically manufactured from lead glass and has a multitude of channels, each one operable to produce cascades of secondary electrons in response to incident electrons. A receiving device then receives the secondary electrons and sends out a signal responsive to the electrons. Since the number of electrons emitted from the microchannel plate is much larger than the number of incident electrons, the signal produced by the device is stronger than it would have been without the microchannel plate.

One example of the use of a photocathode with a microchannel plate is an image intensifier tube. The image intensifier tube is used in night vision devices to amplify low light levels so that the user can see even in very dark conditions. In the image intensifier tube, a photocathode produces electrons in response to photons from an image. The electrons are then accelerated to the microchannel plate, which produces secondary emission electrons in response. The secondary emission electrons are received at a phosphor screen or, alternatively, a charge coupled device (CCD), thus producing a representation of the original image.

Another example of a device that uses a photocathode with a microchannel plate is a scintillation counter used to detect particles. High-energy particles pass through a scintillating material, thereby generating photons. Depending on the type of material used and the energy of the particles, these photons can be small in number. A photocathode in conjunction with a microchannel plate can be used to amplify the photon signal in similar fashion to an image intensifier tube. The detector can thus be used to detect faint particle signals and to transmit a signal to a device, e.g., a counter, that records the particle's presence.

One problem with the use of photocathodes in conjunction with microchannel plates is that the electrostatic fields that accelerate electrons toward the microchannel plate also accelerate positive ions toward the photocathode. Positive ions are common in most image intensifier tubes due to impurities in the tube, including the microchannel plate and the phosphor screen. These impurities can include positive ions and chemically active neutral atoms that can become positively charged. When the positive ions collide with the photocathode, they can cause both physical and chemical damage. This greatly shortens the useful life of the photocathode and the device in which it resides.

The problem of positive ions can be overcome to some extent by placing an ion barrier film on the input side of the microchannel plate. The film serves to block the positive ions from reaching the photocathode. The barrier has the unfortunate side effect of reducing the transmission of electrons. This interference reduces the signal to noise ratio of the detector, e.g., an image intensifier tube.

An alternative method of overcoming the problem removes impurities from the components of an image intensifier tube in order to reduce the number of positive ions impinging on the photocathode. Less positive ions equates to less damage to the photocathode and a longer life for the image intensifier tube.

The aforementioned methods do not provide a means of "hardening" the photocathode itself in order to increase the photocathode's resistance to damage from positive ion collisions. A hardened photocathode would be valuable in that it would have a longer lifetime than a normal photocathode. The hardened photocathode could be used alone or in combination with the impurity removal procedures mentioned above to greatly prolong the lifetime of an image intensifier tube or other device. Consequently, what is needed is a method and system for detecting radiation that incorporates a hardened photocathode and that increases the resistance of the photocathode to ions.

SUMMARY OF THE INVENTION

In accordance with the present invention, a method for producing hardened photocathodes is provided that substantially eliminates or reduces disadvantages and problems associated with using photocathodes and microchannel plates in combination. A method and device for detecting radiation using a hardened photocathode is also provided. The method and device for detecting radiation overcome drawbacks, such as shorter lifespan, associated with similar devices used previously.

A method for detecting radiation is disclosed. The method comprises nine steps. Step one calls for forming a detector having a photocathode with a protective layer of cesium, oxygen and fluorine; a microchannel plate (MCP); and an electron receiver. Step two requires receiving radiation at the photocathode. Step three provides for the photocathode discharging electrons in response to the received photons. In step four, the method provides for accelerating discharged electrons from the photocathode to the input face of the microchannel plate. The next step calls for receiving the electrons at the input face of the microchannel plate. Step six calls for generating a cascade of secondary emission electrons in the microchannel plate in response to the received electrons. The seventh step calls for emitting the secondary emission electrons from the output face of the microchannel plate. In the eighth step, the method provides for receiving secondary emission electrons at the electron receiver. The last step calls for producing an output characteristic of the secondary emission electrons.

A device for detecting radiation is disclosed. The device comprises a photocathode, a microchannel plate and an electron receiver The photocathode is operable to receive radiation on an input side and to discharge electrons from its output side in response. The output side of the photocathode has a protective layer comprising cesium, oxygen and fluorine. The microchannel plate serves to receive electrons on its input face from the photocathode, to produce a cascade of secondary emission electrons and to discharge those electrons from its output face. The electron receiver is operable to receive secondary emissions electrons from the microchannel plate and to produce an output characteristic of those electrons.

A method for manufacturing a hardened photocathode is also disclosed. The method comprises four steps. The first step requires forming a photocathode having an input side for receiving radiation and an output side for discharging electrons. The second through fourth steps require exposing the output side of the photocathode to cesium, oxygen and fluorine respectively.

A technical advantage of the present invention is that the hardened photocathode has a longer usable lifespan than previous photocathodes. This greatly increases the value of devices such as image intensifier tubes that need to be useful for as many hours as possible without requiring replacement. Another technical advantage of the present invention is that a microchannel plate used in conjunction with the hardened photocathode does not need to have an ion barrier film on the microchannel plate. This allows a detector employing the hardened photocathode to have a higher signal to noise ratio.

Still another technical advantage of the present invention is that the hardened photocathode can be used in conjunction with other methods of increasing the lifespan of a detector, such as removing impurities from components of the detector. In addition, other technical advantages may be apparent to one skilled in the art of the present invention.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE DRAWINGS

The preferred embodiment of the present invention and its advantages are best understood by referring to FIGS. 1 through 4 of the drawings, like numerals being used for like and corresponding parts of the various drawings.

Figure 1:
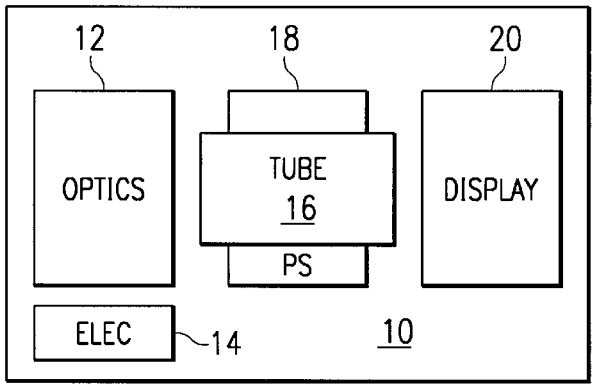
FIG. 1 is a schematic drawing of a device for detecting radiation in accordance with the teachings of the present invention.

FIG. 1 is a schematic design of a device for detecting radiation ("detector") 10 in accordance with the present invention.

In a preferred embodiment, detector 10 is an image intensifier. In this preferred embodiment, detector tube 16 is an image intensifier tube. Image intensifier 10 is operable to receive photons from an object and transform them into a viewable image. Image intensifier 10 is designed to operate and enhance viewing in varying light conditions including conditions where a scene or object is visible with natural vision and conditions where a scene or object is totally invisible with natural vision because the scene is illuminated only by star light or other infrared light sources. However, it will be understood that, although the image intensifier 10 may be used to enhance vision, the image intensifier 10 may also be used in other applications involving photon detection such as systems to inspect semiconductors.

Image intensifier 10 comprises optics 12 coupled to image intensifier tube 16. Image intensifier 10 is operable to act as a photon image intensifier and image generator. Power supply 18 is coupled to image intensifier tube 16. Image intensifier tube 16 also can include an image visualization means 20 for viewing the image produced by image intensifier 10.

Optics 12 are generally one or more lens elements used to form an objective optical assembly. Optics 12 are operable to focus light from a scene on to image intensifier tube 16.

Power supply 18 is operable to provide power to components of image intensifier tube 16. In a typical embodiment power supply 18 provides continuous DC power to image intensifier tube 16. The use of power supply 18 is further described in conjunction with FIG. 2.

Electronics 14 represents the other electronics necessary for image intensifier 10. These include electronics that are used to control among other things, power supply 16.

Image visualization means 20 is operable to provide a convenient display for images generated at image intensifier tube 16. Image visualization means 20 may be as simple as a lens or can be a cathode ray tube (CRT) display.

Figure 2:
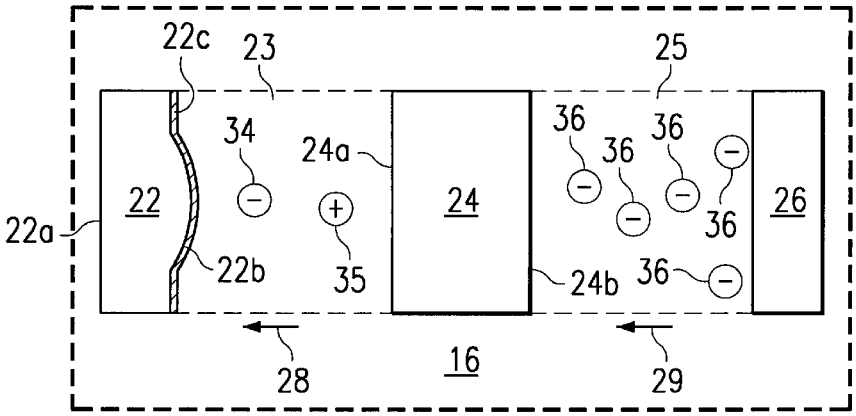
FIG. 2 illustrates, in greater detail, a radiation detector in accordance with the teachings of the present invention.

FIG. 2 illustrates a detector tube 16 in accordance with the teachings of the present invention. Detector tube 16 comprises a photocathode 22 having a input side 22*a* and an output side 22*b*. Coupled to photocathode 22 is a microchannel plate (MCP) 24 having an MCP input side 24*a* and an MCP output side 24*b*. A first electric field 23 having a direction 28 is located between photocathode 22 and microchannel plate 24 Also included is a device for receiving electrons 26 coupled to microchannel plate 24. The device for receiving electrons 26 may be a phosphorous screen, charge coupled device (CCD) or other suitable device for producing a desired output for display 20, depicted in FIG. 1. Between device for detecting electrons 26 and microchannel plate 24 is a second electric field 25 having a direction 29.

In operation, photons from an image impinge on input side of photocathode 22*a*. Photocathode 22 converts photons into electrons 34, which are emitted from output side of photocathode 22*b* in a pattern representative of the original image. Typically, photocathode 22 is a circular disk like structure manufactured from semiconductor materials mounted on a substrate as is well known in the art. One suitable arrangement is gallium arsenide (GaAs) mounted on glass, fiber optics or similarly transparent substrate. On output side 22*b*, photocathode 22 has a protective layer 22*c* comprising cesium, oxygen and fluorine.

The region between photocathode 22 and microchannel plate 24 contains electrons 34 produced by the photocathode 22, positive ions 35 produced by the operation of the tube 16, and a first electric field 23 generated by power supply 18. The ions 35 are typically gas ions trapped in the glass of the microchannel plate during processing. The ions 35 are accelerated by first electric field 23 along the direction of first electric field 28. The ions 35 then impinge on the output face of the photocathode 22*b*. These ions 35 are large, and they can cause physical and chemical damage to a conventional photocathode. However, the photocathode 22 of the present invention has a protective layer 22*c* that reduces the damage to the output face 22*b*. This extends the usable lifetime of the photocathode 22.

The electrons 34 are accelerated in a direction opposite to the direction of the electric field 28, i.e., toward the input face of the microchannel plate 24*a*. After accelerating in first electric field 23, the electrons impinge on the input side 24*a* of microchannel plate 24. Microchannel plate 24 typically comprises a thin glass wafer formed from many hollow fibers, each oriented slightly off axis with respect to incoming electrons. Microchannel plate 24 typically has a conductive electrode layer disposed on MCP input side 24*a* and MCP output side 24*b*. A differential voltage, supplied by power supply 18, is applied across the MCP input 24*a* and MCP output 24*b*. Electrons from photocathode 22 enter microchannel plate 24 where they produce secondary electrons 36, which are accelerated by the differential voltage. The accelerated secondary electrons leave microchannel plate 24 at MCP output 24*b*.

As discussed earlier, typical current microchannel plates contain an ion barrier on the input side in order to protect the photocathode from positive ions that travel from the microchannel plate to the photocathode. Without the ion barrier, the damage from positive ions greatly limits the usable life of the detector (from 260 to 300 hours for a typical image intensifier). The ion barrier prolongs the life of the detector at the expense of reducing the signal to noise ratio of the detector 16.

The device of the present invention does not require an ion barrier to increase its lifespan. Since the photocathode 22 having protective layer 22*c* is resistant to damage from positive ions 35, it is not necessary to employ an ion barrier to protect the photocathode 22. Thus the present invention allows for a longer lifespan without sacrificing the signal to noise ratio of the detector.

After exiting microchannel plate 24, secondary electrons 36 are accelerated in a direction opposite to the direction of second electric field 29, i.e., toward the device for receiving electrons 26. The device for receiving electrons 26 may be any device that can (1) receive electrons and (2) produce an output characteristic of those electrons. In the preferred embodiment described above, the device for receiving electrons 26 may be a phosphorous screen or a charge coupled device (CCD). It is understood that any number of devices to receive electrons might be used by a person well versed in the art in order to produce a desired output, and that such uses are within the scope and spirit of the present invention.

Figure 3:
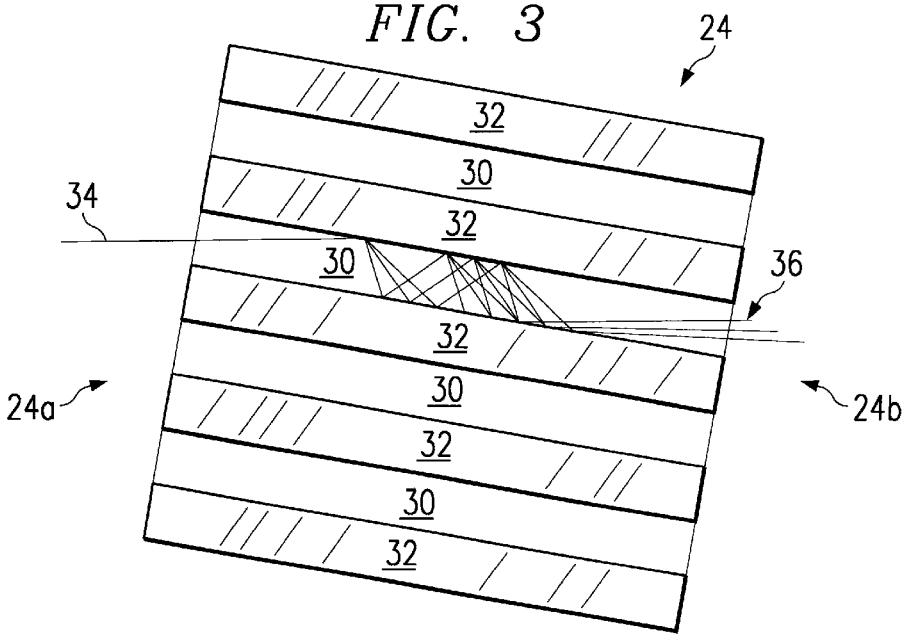
FIG. 3 illustrates a microchannel plate in accordance with the teachings of the present invention.

FIG. 3 illustrates a microchannel plate 24 in accordance with the teachings of the present invention. Illustrated is microchannel plate 24 comprising microchannel plate channels 30 and glass borders 32. As is illustrated in FIG. 3, incoming electrons 34 produce secondary emission electrons 36 by interactions in MCP 24.

In the present invention MCP input side 24*a* does not have an ion barrier film applied. The cladding glass used to manufacture microchannel plate 24 is made electrically conductive to produce secondary emission electrons and can be scrubbed to substantially reduce the amount of damaging ions. An example of suitable cladding glass is disclosed in U.S. Pat. No. 5,015,909, issued to Circon Corporation on May 14, 1991 and entitled "Glass composition and method for manufacturing a high performance microchannel plate". Other similar cladding glass material can also be used. As discussed earlier, each face (MCP input side 24*a* and MCP output side 24*b*) are made to act as electrodes. This is done by depositing a metallic coating such as Nichrome on the MCP input side 24*a* and MCP output side 24*b*. The channels are treated in such a way that incoming electrons produce secondary emission electrons. This is typically done by forming a semi-conducting layer in channels 30.

Figure 4:
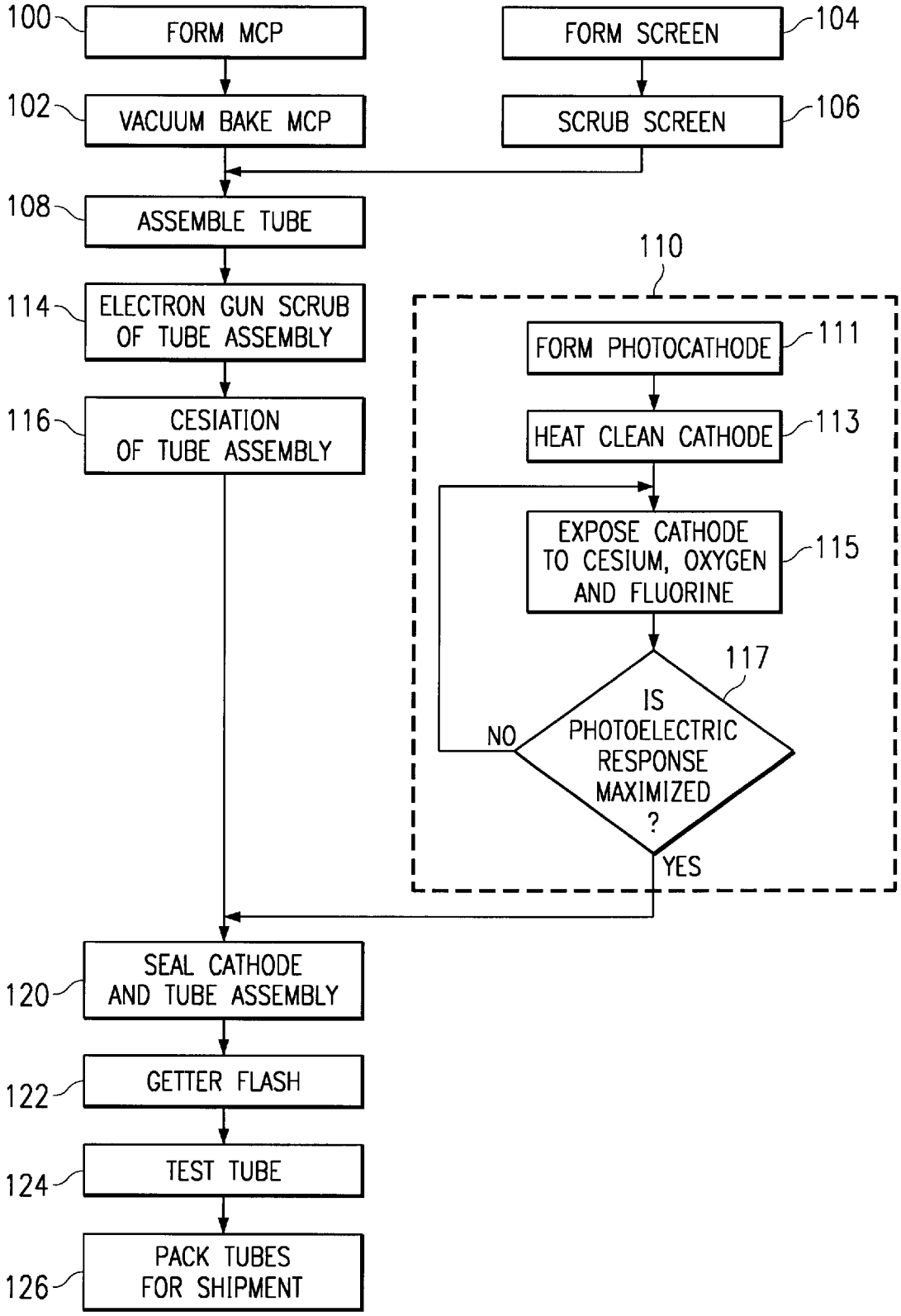
FIG. 4 is a flowchart demonstrating one method of manufacturing a device for detecting radiation in accordance with the present invention.

FIG. 4 is a flowchart illustrating a process for manufacturing an image intensifier according to the teaching of the present invention. In Step 100, a microchannel plate is formed. Microchannel plates are typically formed using a draw/multidraw technique in which many individual tubes are drawn (pulled) along a long axis several times to reduce the width of the tubes. The tubes are then sliced into individual microchannel plates.

In Step 102, the microchannel plate is baked in a vacuum to drive off ions, such as gas ions, in the microchannel plate. In Step 104, the phosphorus screen or CCD is prepared. In Step 106, the screen is scrubbed to remove unwanted gas impurities such as carbon dioxide, carbon monoxide, hydrogen gas and other impurities. In Step 108, the MCP and screen are placed together in a ceramic or metal input body to form a tube assembly.

The steps within box 110 comprise the process of manufacturing a hardened photocathode. In Step 111, a photocathode is formed The photocathode is typically formed from a semiconductor with GaAs or InGaAs layer on a transparent substrate. In Step 113, the photocathode is heated in vacuum to remove oxide layers.

For Step 115, cesium, oxygen and fluorine are introduced into a vacuum chamber containing the photocathode. The photocathode may be exposed to elements in separate steps or in combination. Oxygen and fluorine are preferably introduced into the chamber simultaneously in order to prevent the fluorine from contaminating components of the vacuum system.

In accordance with Step 117, the exposure is continued until the amount of photocurrent produced by the photocathode in response to a given amount of incident light is maximized as is well known to those skilled in the art. The principle behind exposing the photocathode to cesium and oxygen until photoemission is maximized is described in the reference Vergara et al., "Adsorption Kinetics of Cesium and Oxygen on GaAs(100)", *Surface Science*, v. 278, pp. 131–45 (1992). However, the prior art does not teach or suggest the present invention's use of fluorine in combination with cesium and oxygen to protect the photocathode from positive ions. The proper amount of fluorine to be used in the manufacturing process may be determined empirically by measuring the relative lifetime of manufactured photocathodes under positive ion bombardment.

In Step 114, the tube assembly undergoes an electron beam scrub. The electron beam scrub uses a high-energy electron beam to drive out gas impurities that might later contribute to damaging ions. Typically a high intensity electron beam scrub is done over a long period of time.

One drawback to such an electron beam scrub of an unfilmed microchannel plate is that the intensity may be such that the electrons leaving the MCP could burn a hole, or other wise damage, the phosphorous screen. To avoid this, the focus of the electron beam must be set to diffuse the high energy electrons before they reach the screen.

In Step 116, the tube assembly goes through a cesiation process. Cesium is a good gas eliminator (also known as a gas getter) which is used to remove even more gas based impurities from the screen and microchannel plate.

After Steps 116 and 118, the MCP/screen elements are assembled together in step 120. In Step 122, a wire of Ti/Ta is used as a final gas getter to remove any last impurities. After this is completed, the tube is tested in Step 124 and packed for shipment in Step 126.

While the foregoing description has particularly focused on the use of the present invention within image intensifiers, it will be understood by those skilled in the art that the method and device herein may be used in a number of other applications involving the detection of radiation, especially low-level electromagnetic radiation. It will also be understood by those skilled in the art that various other changes in form and detail may be made without departing from the spirit and scope of the invention.

What is claimed is:

1. A method for detecting radiation comprising:

forming a detector having a photocathode with a protective layer of cesium, oxygen and fluorine, a microchannel plate and an electron receiver for generating signals responsive to received electrons;

receiving radiation at the photocathode;

discharging electrons from the photocathode in response to the received radiation;

accelerating discharged electrons toward an input face of the microchannel plate;

receiving electrons at the input face of the microchannel plate;

generating secondary emission electrons in the microchannel plate in response to the received electrons;

emitting secondary emission electrons from the output face of the microchannel plate;

receiving secondary emission electrons at the electron receiver; and producing an output characteristic of the received secondary emission electrons.

2. The method of claim 1, wherein the detected radiation is electromagnetic radiation having a wavelength within the range spanning from far infrared to ultraviolet.

3. The method of claim 1, wherein the detected radiation is visible light from an image and the output produced by the electron receiver is a representation of the image.

4. The method of claim 1, wherein the electron receiver is a phosphor screen.

5. The method of claim 1, wherein the electron receiver is a charge coupled device (CCD).

6. The method of claim 3, wherein the method is used for night vision devices.

7. A device for detecting radiation comprising:

a photocathode operable to receive radiation at an input side and to produce electrons at an output side in response to the received radiation, the output side of the photocathode having a protective layer comprising cesium, oxygen and fluorine;

a microchannel plate operable to receive electrons from the photocathode at an input face and to emit secondary emission electrons in response from an output face; and an electron receiver operable to receive secondary emission electrons and to produce an output characteristic of the received secondary emission electrons.

8. The device of claim 7, wherein the received radiation is electromagnetic radiation having a wavelength within the range spanning from far infrared to ultraviolet.

9. The device of claim 7, wherein the received radiation is visible light from an image and the output is a representation of the image.

10. The device of claim 9, wherein the device is used for night vision.

11. The device of claim 7, further comprising a power supply operable to produce electric fields to accelerate electrons between components of the device.

12. The device of claim 7, further comprising optics operable to focus radiation onto the photocathode.

13. The device of claim 7, wherein the microchannel plate has an unfilmed input face.

14. The device of claim 7, wherein the electron receiver is a phosphor screen.

15. The device of claim 7, wherein the electron receiver is a charge coupled device (CCD).

* * * * *